US009513004B2

(12) United States Patent
Cadeau et al.

(10) Patent No.: US 9,513,004 B2
(45) Date of Patent: Dec. 6, 2016

(54) SWITCH OF A GAS VALVE UNIT

(75) Inventors: Christophe Cadeau, Strasbourg (FR); Stéphane Clauss, Stotzheim (FR); Alexander Eisenberg, Detmold (DE); Jörn Naumann, Durbach (DE)

(73) Assignee: BSH Hausgeräte GmbH, Munich (DE)

( * ) Notice: Subject to any disclaimer, the term of this patent is extended or adjusted under 35 U.S.C. 154(b) by 1354 days.

(21) Appl. No.: 13/384,601

(22) PCT Filed: Jul. 15, 2010

(86) PCT No.: PCT/EP2010/060173

§ 371 (c)(1),
(2), (4) Date: Jan. 18, 2012

(87) PCT Pub. No.: WO2011/009792

PCT Pub. Date: Jan. 27, 2011

(65) Prior Publication Data

US 2012/0118280 A1 May 17, 2012

(30) Foreign Application Priority Data

Jul. 24, 2009 (EP) ..... 09290589
Mar. 8, 2010 (EP) ..... 10290115

(51) Int. Cl.
*F24C 3/12* (2006.01)
*F23N 1/00* (2006.01)

(52) U.S. Cl.
CPC ..... *F23N 1/007* (2013.01); *F23N 2035/16* (2013.01); *F23N 2035/18* (2013.01);
(Continued)

(58) Field of Classification Search
USPC ..... 126/52; 137/599.01, 599.05, 601.01, 137/601.14, 601.15, 628, 629, 630.16, 630.17, 137/637; 251/65; 431/280
See application file for complete search history.

(56) References Cited

U.S. PATENT DOCUMENTS 2,229,903 A * 1/1941 Schmohl ..... F16K 1/52 137/599.05
2,601,321 A 6/1952 Ray
(Continued)

FOREIGN PATENT DOCUMENTS

CN 1414295 A 4/2003
DE 10249938 A1 5/2004
(Continued)

OTHER PUBLICATIONS

Report of Examination including National Search Report date Dec. 17, 2013.
International Search Report PCT/EP2010/060173.

*Primary Examiner* — Gregory Huson
*Assistant Examiner* — Martha Becton
(74) *Attorney, Agent, or Firm* — Michael E. Tschupp; Andre Pallapies

(57) ABSTRACT

A gas valve unit for adjusting a volumetric gas flow supplied to a gas burner of a gas appliance, in particular a gas cooking appliance. The gas valve unit has a gas inlet, at least two open/close valves, at least two throttle points and a gas outlet. The gas valve unit includes a throttle segment in which the throttle points are arranged in series and each pair of adjacent throttle points is connected by corresponding connecting section. The inlet sides of at least two open/close valves are connected to the gas inlet, and the outlet side of at least one open/close valve leads into a connecting section of the throttle segment.

19 Claims, 9 Drawing Sheets

(52) U.S. Cl.
CPC ..... *F23N 2035/22* (2013.01); *F23N 2035/24* (2013.01); *F23N 2041/08* (2013.01)

(56) References Cited

U.S. PATENT DOCUMENTS 2,639,727 A 5/1953 Ray
2,918,042 A * 12/1959 Jensen ..... F15B 21/08 91/459
2,920,254 A * 1/1960 Ray ..... H01F 7/088 251/30.02
3,022,450 A * 2/1962 Chase, Jr. ..... H01F 7/1615 29/527.6
3,027,918 A * 4/1962 Robra ..... B21C 31/00 137/601.05
3,543,797 A * 12/1970 Goy ..... F16K 31/0665 137/628
3,552,436 A * 1/1971 Stewart ..... F15B 13/00 137/878
3,603,349 A * 9/1971 Botnick ..... F16K 19/00 137/599.03
3,894,719 A * 7/1975 Horvath ..... C02F 1/42 137/636.1
3,918,480 A * 11/1975 Leo ..... B23K 7/10 137/488
4,030,523 A * 6/1977 Cram ..... A23G 9/228 137/599.07
4,170,245 A * 10/1979 Haley ..... F15B 11/0426 137/487.5
4,478,246 A * 10/1984 Sherrod ..... F17D 1/04 137/557
4,481,389 A * 11/1984 Johnson ..... F16K 31/086 200/61.86
4,565,207 A * 1/1986 Sherrod ..... F17D 1/04 137/1
4,644,967 A * 2/1987 Wyatt ..... F22B 1/26 137/599.05
4,858,636 A * 8/1989 Adkins ..... A01G 25/023 137/497
5,174,337 A * 12/1992 Dahlen ..... C02F 1/42 137/599.08
5,900,214 A * 5/1999 Girard ..... F16K 7/16 137/597
5,938,425 A 8/1999 Damrath et al.
6,726,175 B1 4/2004 Saba et al.
7,513,247 B2 4/2009 Clauss et al.
8,667,988 B2 * 3/2014 Cadeau ..... F23N 1/007 137/627.5
9,080,678 B2 * 7/2015 Naumann ..... F16K 11/22
2006/0016444 A1 * 1/2006 Clauss ..... F23N 1/005 126/39 E
2006/0057520 A1 * 3/2006 Saia ..... F23N 1/005 431/281
2010/0139797 A1 * 6/2010 Delamarche ..... B01F 5/0611 137/806
2012/0111434 A1 * 5/2012 Cadeau ..... F23N 1/007 137/597
2013/0056663 A1 * 3/2013 Cadeau ..... F23K 5/007 251/205
2013/0059256 A1 * 3/2013 Cadeau ..... F23N 1/00 431/280
2013/0153065 A1 * 6/2013 Naumann ..... F16K 31/084 137/613

FOREIGN PATENT DOCUMENTS

EP 0884530 A1 12/1998
JP 2006010243 A 1/2006

* cited by examiner

SWITCH OF A GAS VALVE UNIT

BACKGROUND OF THE INVENTION

The invention relates to a gas valve unit for adjusting a volumetric gas flow supplied to a gas burner of a gas appliance, in particular a gas cooking appliance, wherein the gas valve unit has a gas inlet, at least two open/close valves, at least two throttle points and a gas outlet.

Gas valve units of the aforesaid type are described, for example, in the publications EP0818655A2 and WO2004063629A1. By means of gas valve units of this type the volumetric gas flow supplied to a gas burner of a gas appliance can be controlled in a plurality of stages. In this case the volumetric gas flow possesses a reproducible magnitude at each stage. The effective through-flow cross-section of the gas valve unit overall—and hence the magnitude of the volumetric gas flow—is adjusted by opening or closing specific open/close valves of the gas valve unit and thereby releasing or interrupting the gas flow through specific throttle openings.

In the known gas valve units according to EP0818655A2 and WO2004063629A1, a plurality of parallel secondary gas lines branch off after the gas inlet, each of said lines having an open/close valve and a throttle point. All of the secondary gas lines lead into a common gas outlet. In another embodiment variant of EP0818655A2, a plurality of throttle points are connected in series and each is provided with a bypass. In addition, an open/close valve is arranged in each bypass. The known embodiment variants serve to adjust the through-flow cross-section of the overall gas valve unit in a plurality of stages, whereby the open/close valves are opened and closed individually and independently of one another. In this arrangement switching operations are provided in which one open/close valve must be opened and another open/close valve closed at exactly the same time. During practical operation switching operations of said kind result in the volumetric gas flow being briefly reduced or increased to an undesired value and consequently the flame at the gas burner is temporarily reduced or increased in size.

BRIEF SUMMARY OF THE INVENTION

The object underlying the present invention is to provide a generic gas valve unit having an improved switching behavior.

This object is achieved according to the invention in that the gas valve unit includes a throttle segment in which the throttle points are arranged in series and which has a connecting section between two adjacent throttle points in each case, and in that at least two open/close valves are connected to the gas inlet on the inlet side and at least one open/close valve leads into a connecting section of the throttle segment on the outlet side. By definition the throttle segment comprises a plurality of throttle points which are connected in series and interconnected with one another by means of connecting sections. An open/close valve which is connected on the inlet side to the gas inlet of the gas valve unit leads into each connecting section. Opening an open/close valve causes all the throttle points which are located in the series circuit of the throttle points upstream of the connecting section into which the open/close valve leads to be bypassed. On the way to the gas outlet of the gas valve unit, the gas flow then flows only through those throttle points that are disposed downstream of the connecting section into which the open/close valve leads. In order to adjust the volumetric gas flow, the throttle points are bypassed in succession by at least one open/close valve being opened in each case. It is not necessary in this case to open one open/close valve and simultaneously close another. In this way undesirable switchover surges in the volumetric gas flow can be reliably avoided.

Preferably the throttle segment has a plurality of, preferably at least four, throttle points, the throttle segment has a connecting section between each two adjacent throttle points, and an open/close valve leads into each of the connecting sections. The number of throttle points and open/close valves exactly matches the number of switching stages for the volumetric gas flow to the gas burner. The more open/close valves and throttle points are provided, the more finely the volumetric gas flow and hence the burning performance of the gas burner can be adjusted.

Upstream of the first throttle point—viewed in the gas flow direction—the throttle segment also has an inlet section, and an open/close valve is connected on the inlet side to the gas inlet and leads on the outlet side into the inlet section of the throttle segment. By inlet section is meant the line section of the throttle segment upstream of the first throttle point. In addition to the connecting sections, the inlet section can also be connected by way of precisely one open/close valve to the gas inlet of the gas valve unit. The open/close valve represents the only connection of the inlet section to the gas inlet.

Advantageously the throttle points have an increasing flow cross-section, viewed in the gas flow direction. The first throttle point with the smallest flow cross-section defines the minimum burning performance of the gas burner. The gas burner is operated at said minimum burning performance when only the first open/close valve leading into the inlet section of the throttle segment is open. On the way to the gas outlet of the gas valve unit, the gas flow then likewise flows through all further throttle points of the throttle segment. Said further throttle points possess a greater flow cross-section and represent only a small flow resistance for the small minimum gas flow that is defined by the first throttle point. The action of opening the second open/close valve now results in the first throttle point being bypassed, so that now the second throttle point defines the relevant flow cross-section for adjusting the volumetric gas flow. Since the second throttle position has a greater flow cross-section than the first throttle point, the volumetric gas flow also self-adjusts to a greater value. Analogously hereto, the first and second throttle points are bypassed when the third open/close valve is opened. The defining factor for the volumetric gas flow is then the effective flow cross-section of the remaining further throttle points on the way to the outlet. This mode of operation continues analogously for the further throttle points with their associated open/close valves.

Each throttle point consists of at least one individual throttle which is preferably implemented as a throttle opening having a defined flow cross-section.

Particularly advantageously, each throttle point consists of precisely two individual throttles arranged in series. Said two individual throttles, which together form a throttle point, preferably possess identical flow cross-sections. In order to obtain a comparable throttling effect, the two individual throttles arranged in series can each have a greater cross-section than a throttle point that has only a single individual throttle. Producing particularly small throttle openings proves difficult in practice. For this reason the embodiment variant in which each throttle point consists of two individual throttles is easier to manufacture.

The described gas valve unit is implemented in such a way that the volumetric gas flow flowing through the gas valve unit is equal to zero when all the open/close valves are closed. The gas valve unit is therefore suitable also for interrupting the gas supply to the gas burner completely.

The volumetric gas flow flowing through the gas valve unit is set to a minimum value at which a gas burner associated with the gas valve unit is operated at minimum power when only the first open/close valve leading into the inlet section of the throttle segment is open. As already explained above, at this setting of the open/close valves the volumetric gas flow flows through all the throttle points of the throttle segment in turn.

The volumetric gas flow flowing through the gas valve unit is set to a maximum value at which a gas burner associated with the gas valve unit is operated at maximum power when at least the last open/close valve leading into the last—viewed in the gas flow direction—connecting section of the throttle segment is open. On the way from the gas inlet to the gas outlet of the gas valve unit, the volumetric gas flow then flows only through the last throttle point of the throttle segment. Said last throttle point has a flow cross-section which throttles the volumetric gas flow only slightly or not at all.

The volumetric gas flow flowing through the gas valve unit is set to an intermediate value at which a gas burner associated with the gas valve unit is operated at a power between the minimum power and the maximum power when at least one of the open/close valves which leads into a middle connecting section that is disposed between the inlet section and the last connecting section is open, and at least those open/close valves which lead into a connecting section downstream of the middle connecting section are closed. If a plurality of open/close valves are open, the size of the volumetric gas flow is determined by the throttle point lying furthest downstream and connected directly to the gas inlet of the gas valve unit as well as by the following throttle points downstream. A further throttle point lying in the flow direction upstream of said throttle point lying furthest downstream and likewise directly connected to the gas inlet does not contribute to the volumetric gas flow at the gas outlet of the gas valve unit.

Particularly advantageously, an actuating mechanism for the open/close valves is provided which is implemented in such a way that either all of the open/close valves are closed, or precisely one open/close valve is open, or precisely two open/close valves are open which are connected to two adjacent connecting sections or to the inlet section and the adjacent connecting section. When the gas valve unit is actuated the open/close valves are switched strictly in succession. Normally, precisely one open/close valve is open at each switching stage, while the other open/close valves are closed. During a switchover from one switching position to the next switching position of the gas valve unit it must be ensured that at no time will all of the open/close valves be closed. Instead the switchover operation is configured in such a way that in an intermediate position between two switching positions two adjacent open/close valves are always open. In said intermediate position the volumetric gas flow exactly corresponds to the greater volumetric gas flow of the two adjacent switching positions.

According to a particularly advantageous embodiment of the invention the open/close valves can be actuated by means of a permanent magnet. In this case the magnetic force of the permanent magnet is used for opening or closing the open/close valve.

For that purpose each open/close valve has a movable shut-off body which bears against a valve seat when the open/close valve is closed and thereby seals a valve orifice in the valve seat.

A spring is provided which presses the shut-off body onto the valve seat when the open/close valve is in the closed state. In order to open the open/close valve the shut-off body can be lifted off from the valve seat by means of the force of a permanent magnet. Thus, the closing force of each open/close valve is generated by a spring which closes the open/close valve irrespective of the installation position of the gas valve unit. The shut-off body can be lifted off from the valve seat against the force of the spring by means of the force of the permanent magnet. The position of the permanent magnet relative to the shut-off body of the open/close valve can be varied in order to actuate the open/close valve. In order to switch the gas valve unit, the permanent magnet is moved across the shut-off bodies of the open/close valves. Those shut-off bodies that are located in the immediate vicinity of the permanent magnet are attracted by the permanent magnet and as a result the open/close valve is opened. The open/close valve then remains open until such time as the permanent magnet is moved away again out of the range of the shut-off body.

According to a particular embodiment of the invention it is provided that—starting from a closed position in which all of the open/close valves are closed—when the gas valve unit is opened, the last open/close valve leading into the last—viewed in the gas flow direction—connecting section of the throttle segment is opened first. This means that upon the gas valve unit being actuated, said unit immediately opens completely and subsequently the gas flow can be throttled again in stages. The instant complete opening of the gas valve unit has the advantage that the lines and the gas burner after the gas valve unit quickly fill with gas. Furthermore, after the gas valve unit has been opened a downstream gas burner can immediately be ignited at maximum gas flow.

BRIEF DESCRIPTION OF THE DRAWINGS

Further advantages and details of the invention are explained in more detail with reference to the exemplary embodiments illustrated in the schematic figures, in which.

DETAILED DESCRIPTION OF EXEMPLARY EMBODIMENTS OF THE PRESENT INVENTION

Figure 1:
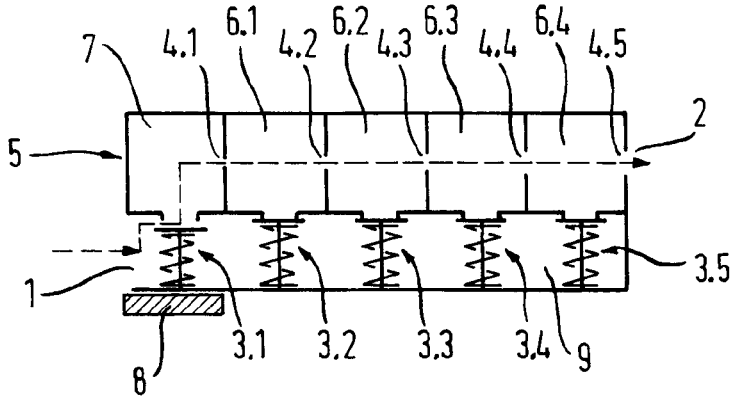
FIG. 1 shows a schematic switching arrangement of the gas valve unit with a first open/close valve open.

FIG. 1 shows the switching arrangement of the gas valve unit according to the invention. The figure depicts a gas inlet 1 by means of which the gas valve unit is connected for example to a main gas line of a gas cooking appliance. The gas provided for burning is present at the gas inlet 1 at a constant pressure of, for example, 20 millibars or 50 millibars. A gas line leading for example to a gas burner of the gas cooking appliance is connected to a gas outlet 2 of the gas valve unit. The gas inlet 1 is connected by way of a gas inlet chamber 9 of the gas valve unit to the inlet side of the five (in the present exemplary embodiment) open/close valves 3 (3.1 to 3.5). Opening the open/close valves 3 causes the gas inlet 1 to be connected in each case to a specific section of a throttle segment 5 into which the gas flows via the opened open/close valve 3. The throttle segment 5 includes an inlet section 7 into which the first open/close valve 3.1 leads. The further open/close valves 3.2 to 3.5 each lead into a respective connecting section 6 (6.1 to 6.4) of the throttle segment 5. The transition between the inlet section 7 and the first connecting section 6.1, like the transitions between two adjacent sections of the connecting sections 6.1 to 6.4, is formed in each case by a throttle point 4 (4.1 to 4.5). The last throttle point 4.5 connects the last connecting section 6.4 to the gas outlet 2. The throttle points 4.1 to 4.5 possess a sequentially increasing opening cross-section. The through-flow cross-section chosen for the last throttle point 4.5 can be so large that the last throttle point 4.5 possesses practically no throttling function.

The open/close valves 3 are actuated by means of a permanent magnet 8 which is movable along the row of open/close valves 3. In this arrangement the force required for opening the respective open/close valve 3 is created directly by the magnetic force of the permanent magnet 8. Said magnetic force opens the respective open/close valve 3 against a spring force.

Only the first open/close valve 3.1 is open in the switching position according to FIG. 1. The gas flows from the gas inlet chamber 9 through said open/close valve 3.1 into the inlet section 7 and from there passes all throttle points 4 and all connecting sections 6 on the way to the gas outlet 2. The volume of gas flowing through the valve unit dictates the minimum performance of the gas burner connected to the gas valve unit.

Figure 2:
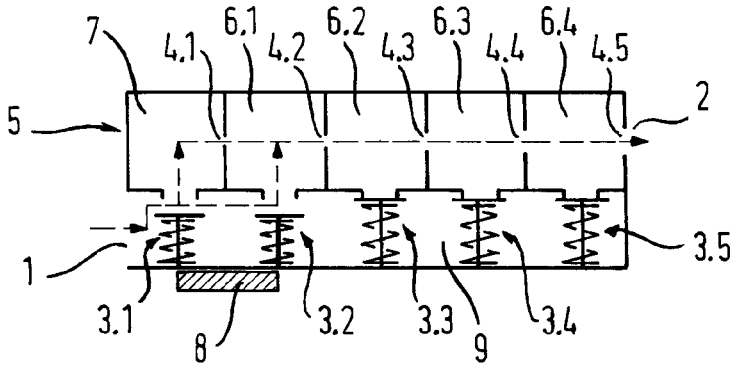
FIG. 2 shows the schematic switching arrangement with two open/close valves open.

FIG. 2 shows the schematic switching arrangement in which the permanent magnet 8 is moved to the right in the drawing such that both the first open/close valve 3.1 and the second open/close valve 3.2 are open.

The gas flows from the gas inlet chamber 9 through the open second open/close valve 3.2 directly into the first connecting section 6.1 and from there via the throttle points 4.2 to 4.5 to the gas outlet 2. Because the open/close valve 3.2 is open the gas flowing to the gas outlet 2 bypasses the first throttle point 4.1. The volumetric gas flow in the switching position according to FIG. 2 is therefore greater than the volumetric gas flow in the switching position according to FIG. 1. The gas inflow into the first connecting section 6.1 takes place practically exclusively via the second open/close valve 3.2. Owing to the open/close valves 3.1 and 3.2 remaining in the open state the same pressure level prevails in the inlet section 7 as in the first connecting section 6.1. For this reason virtually no further gas flows out of the inlet section 7 via the first throttle point 4.1 into the first connecting section 6.1. There is therefore practically no change in the volumetric gas flow flowing overall through the gas valve unit when the permanent magnet 8 is moved further to the right in the drawing and as a result the first open/close valve 3.1 is closed while the second open/close valve 3.2 is open.

By the permanent magnet 8 being moved to the right in the drawing the open/close valves 3.3 to 3.5 are opened in succession and the volumetric gas flow through the gas valve unit is thereby increased step by step.

Figure 3:
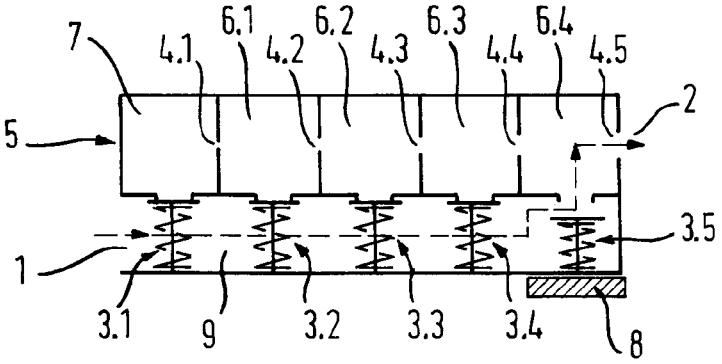
FIG. 3 shows the schematic switching arrangement with the last open/close valve open.

FIG. 3 shows the schematic switching arrangement of the gas valve unit in the maximum open position. In this case the permanent magnet 8 is located at its end position on the right-hand side in the drawing. In this position of the permanent magnet 8 the last open/close valve 3.5 is open. In this case gas flows directly from the gas inlet chamber 9 into the last connecting section 6.4 and passes only the last throttle point 4.5 on the way to the gas outlet 2. Said last throttle point 4.5 can have a through-flow cross-section that is so great that practically no throttling of the gas flow occurs and the gas can flow practically without restriction through the gas valve unit.

FIGS. 4 to 8 schematically show a constructional layout of a gas valve unit having a switching arrangement according to FIGS. 1 to 3. A valve body 20 can be seen in which the gas inlet 1 of the gas valve unit is embodied. Located in the interior of the valve body 20 is a gas inlet chamber 9 connected to the gas inlet 1. Shut-off bodies 10 of the open/close valves 3 are guided in the valve body 20 in such a way that they can move upward and downward as shown in the drawing. Each shut-off body 10 is pretensioned downward as shown in the drawing by means of a spring 11. Each shut-off body 10 can be moved upward as shown in the drawing against the force of the spring 11 by means of the force of the permanent magnet 8. The springs 11 press the shut-off bodies onto a valve sealing plate 12 so that the shut-off bodies 10 seal the orifices 12*a* present in the valve sealing plate 12 in a gas-tight manner. Arranged below the valve sealing plate 12 is a pressure plate 13 having apertures 13*a* corresponding to the orifices 12*a* in the valve sealing plate 12. The apertures 13*a* in the pressure plate 13 lead into apertures 14*a* in a first gas distribution plate 14. According to the drawing, a throttle plate 15 having a plurality of throttle openings 18 is located below the first gas distribution plate 14. In this arrangement each of the throttle points 4.1 to 4.4 is formed by two throttle openings 18. The two throttle openings 18 belonging to one throttle point 4.1 to 4.4 are in each case connected to each other by means of the apertures 16*a* in a second gas distribution plate 16. The apertures 14*a* in the first gas distribution plate, on the other hand, connect the adjacently located throttle openings 18 of two adjacent throttle points 4.1 to 4.5. The last throttle point 4.5 consists of just one throttle opening 18 which leads via a corresponding aperture 16*a* in the second gas distribution plate 16 into the gas outlet 2 of the gas valve unit.

Figure 4:
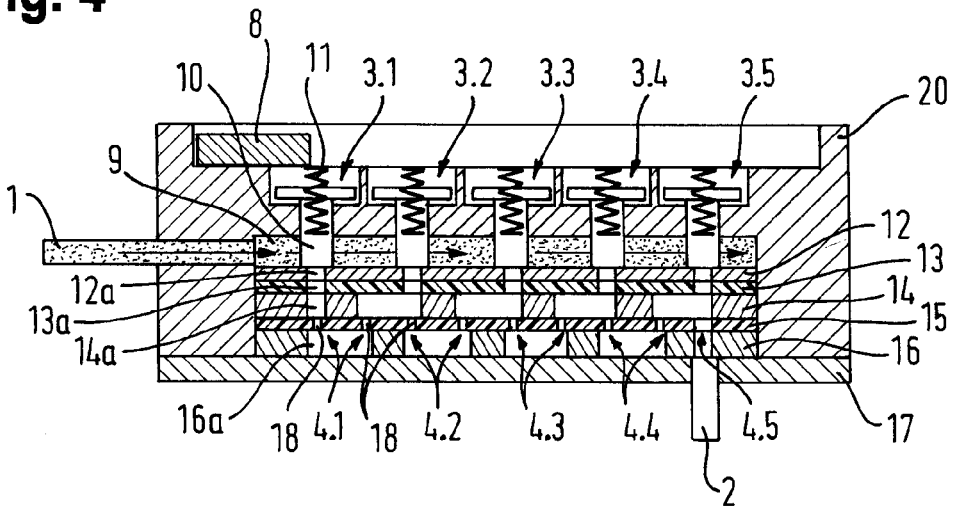
FIG. 4 shows the schematic structure of the gas valve arrangement with open/close valves closed.

In the switching position according to FIG. 4 the permanent magnet 8 is located at an end position in which all of the open/close valves 3 are closed. The gas valve unit as a whole is therefore closed. The volumetric gas flow is equal to zero.

Figure 5:
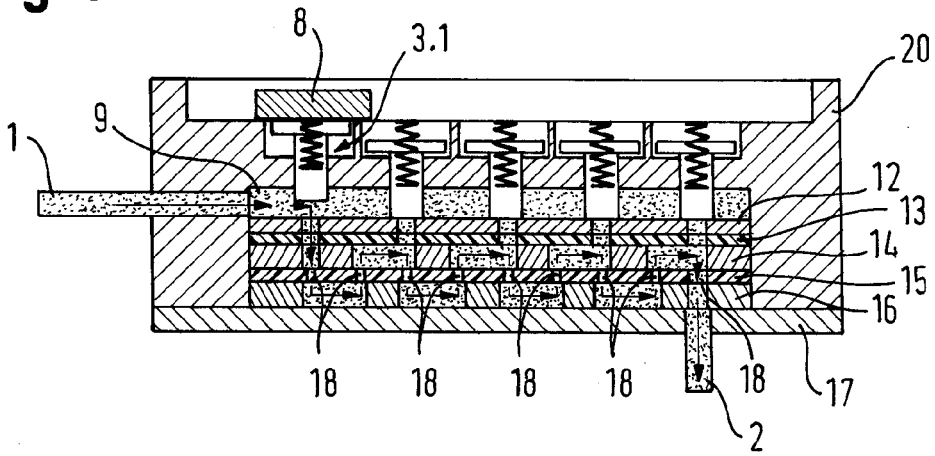
FIG. 5 shows the schematic structure with one open/close valve open.

FIG. 5 shows the schematic structure of the gas valve unit with the first open/close valve 3.1 open. The gas flows from the gas inlet 1 into the gas inlet chamber 9 and from there via the first orifice in each case of the valve sealing plate 12, the pressure plate 13 and the first gas distribution plate 14 to the throttle plate 15. On the way to the gas outlet 2 the gas flows through all the throttle openings 18 of the throttle plate 15 as well as through all the apertures 14*a* of the first gas distribution plate 14 and all the apertures 16*a* of the second gas distribution plate 16.

Figure 6:
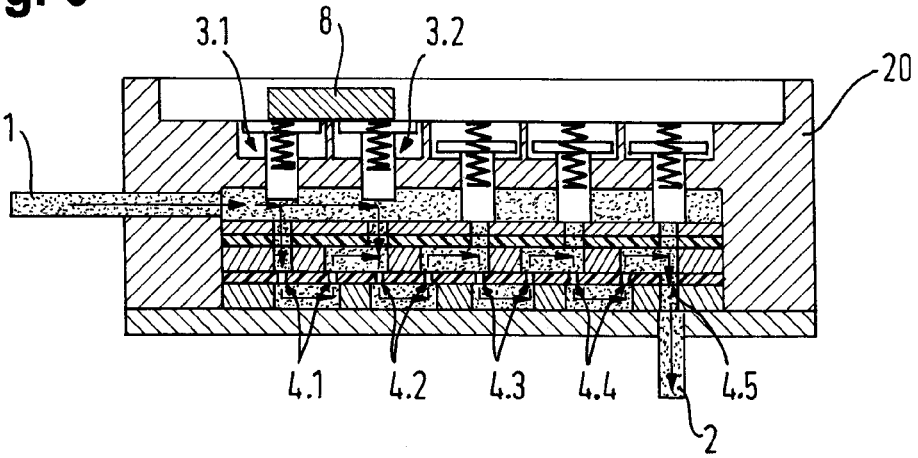
FIG. 6 shows the schematic structure with the first two open/close valves open.

FIG. 6 shows the schematic structure with both first open/close valve 3.1 and second open/close valve 3.2 open. Because the second open/close valve 3.2 is open the throttle openings 18 of the first throttle point 4.1 are bypassed, with the result that the gas goes directly to the second throttle point 4.2 and flows through the further throttle points 4.3 to 4.5 on the way to the gas outlet 2. Because the first open/close valve 3.1 is open the gas path via the first throttle point 4.1 is open. Practically no gas flows through the first throttle point 4.1 owing to the same pressure level prevailing on both sides of the first throttle point 4.1.

Figure 7:
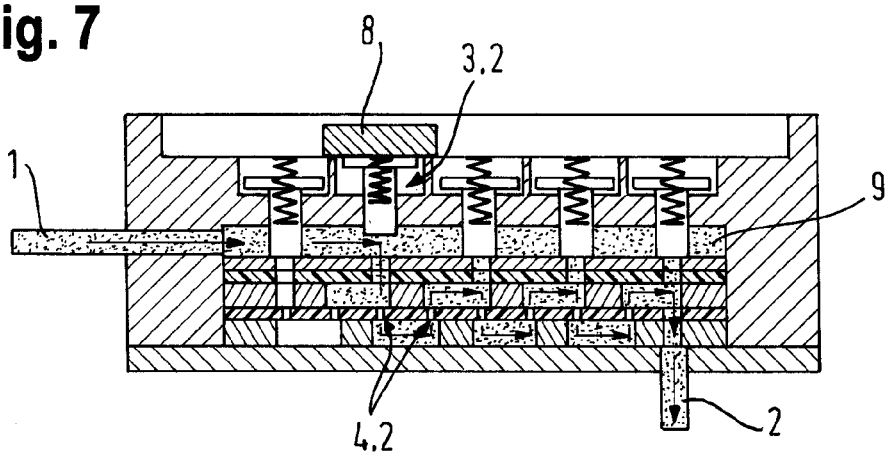
FIG. 7 shows the schematic structure with the open/close valve open.

FIG. 7 shows the schematic structure with the second open/close valve 3.2 open. All the other open/close valves 3.1 and 3.3 to 3.5 are closed. The volumetric gas flow through the gas valve unit is practically identical to the volumetric gas flow in the valve position according to FIG. 6.

The permanent magnet 8 and the components of the open/close valves 3 are coordinated with one another in such a way that when the gas valve unit is open either precisely one open/close valve 3 is open or precisely two open/close valves 3 are open. During the switchover from one open/close valve 3 to an adjacent open/close valve 3, both adjacent open/close valves 3 are always open together briefly. This ensures that a switchover does not lead to a temporary interruption of the gas supply to a gas burner and consequently to flickering or extinction of the gas flames. By means of the above-described switch it is also ensured that no momentary increase in the volumetric gas flow occurs during a switchover operation. Flaring up of the gas flames during a switchover operation is also reliably prevented in this way.

Figure 8:
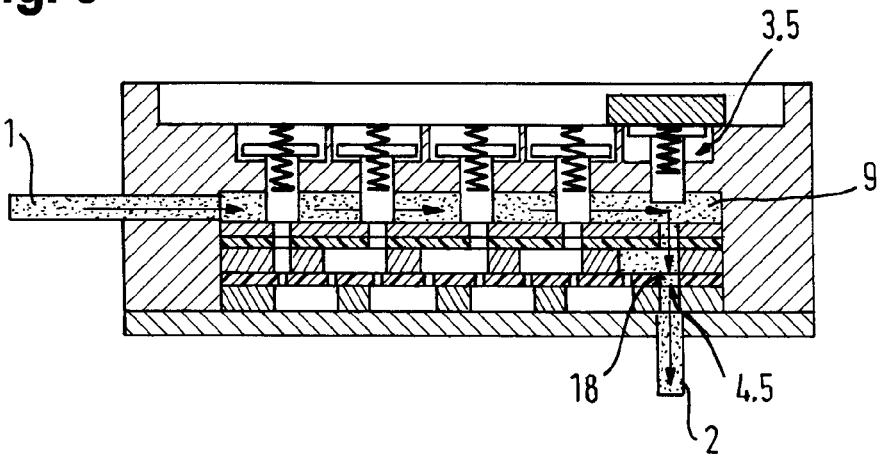
FIG. 8 shows the schematic structure with the last open/close valve open.

FIG. 8, finally, shows the schematic structure of the gas valve unit when only the last open/close valve 3.5 is open. In this case the gas flows from the gas inlet via the gas inlet chamber, the opened open/close valve 3.5 and the last throttle opening 18 associated therewith practically without obstruction to the gas outlet.

Figure 9:
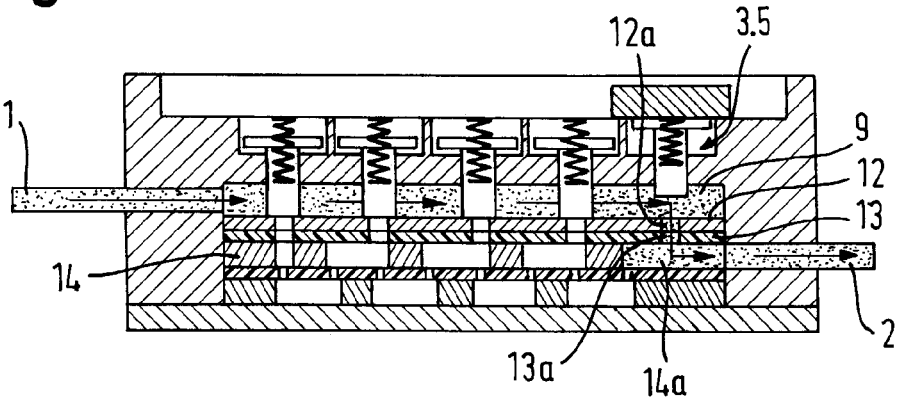
FIG. 9 shows the schematic structure of a variant of the gas valve unit.

FIG. 9 shows the schematic structure of a variant of the gas valve unit. In contrast to the embodiment according to FIGS. 4 to 8, in this case the gas outlet 2 branches off directly from the first gas distribution plate 14. With open/close valve 3.5 open, the gas flows unthrottled via the gas inlet 1, the gas inlet chamber 9, the open/close valve 3.5, the last orifice 12*a* in the valve sealing plate 12, the last aperture 13*a* in the pressure plate 13 and the last aperture 14*a* in the first gas distribution plate 14 to the gas outlet 2. The last throttle point 4.5 (see FIGS. 4 to 8) is not present in the variant according to FIG. 9.

Figure 10:
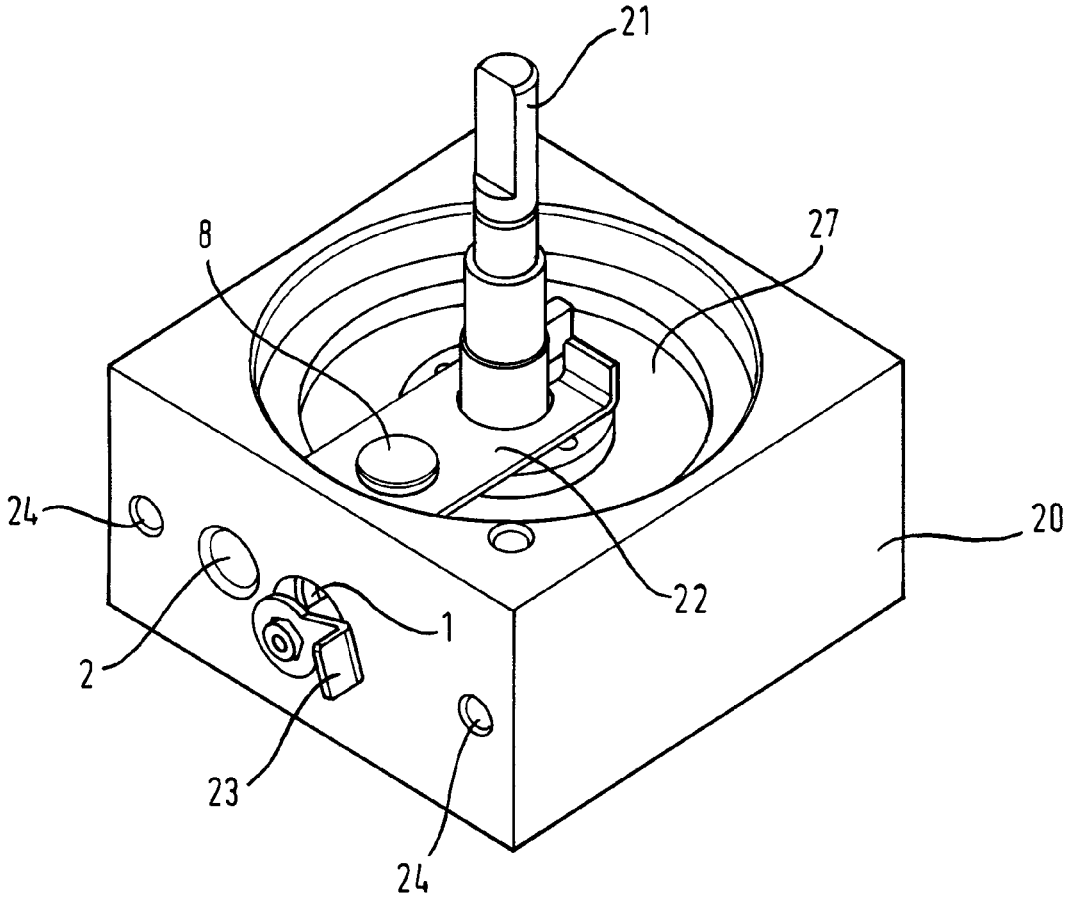
FIG. 10 shows the gas valve unit in a perspective view obliquely from above.

FIG. 10 shows an exemplary embodiment of the gas valve unit in a perspective view obliquely from above. Clearly to be seen in the figure is a valve body 20 in which a switching shaft 21 of the gas valve unit is rotatably mounted. Coupled to the switching shaft 21 is a driver 22 which transmits a rotary movement of the switching shaft 21 to a permanent magnet 8 which is thereby guided on a circular path during a rotary movement of the switching shaft 21. A cover 27 forms a sliding surface for the permanent magnet 8 and establishes a defined clearance between the permanent magnet 8 and the open/close valves 3. Also evident is the gas outlet 2 and an actuating lever 23 arranged in the gas inlet 1 for a solenoid valve unit (not shown). The actuating lever 23 is coupled to the switching shaft in such a way that when the switching shaft is subjected to axial pressure the actuating lever 23 travels out of the valve body 20. Accordingly, the solenoid valve unit can be opened by pressing the switching shaft 21. Boreholes 24 serve for securing the solenoid valve unit to the valve body.

Figure 11:
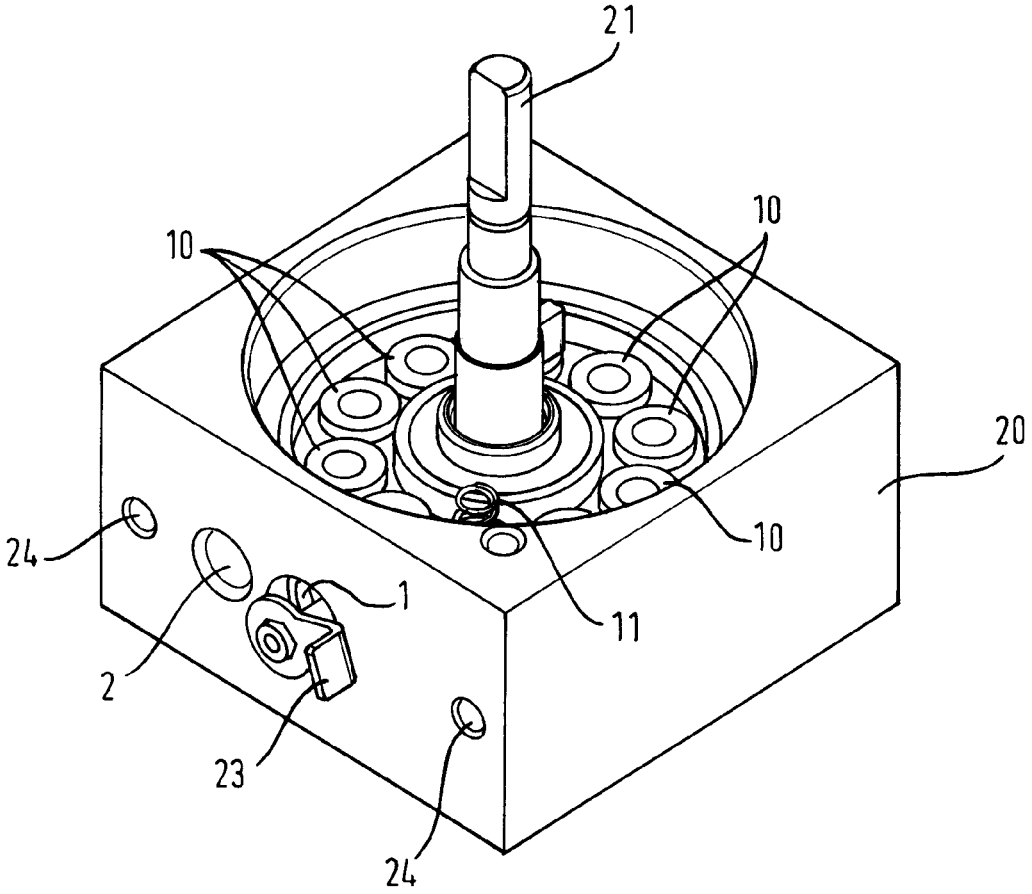
FIG. 11 shows the perspective view looking onto the open/close valves.

FIG. 11 shows the view according to FIG. 10 with the driver 22 and the permanent magnet 8 omitted. Clearly to be seen in FIG. 11 are in particular the annularly arranged shut-off bodies 10 of the open/close valves 3. Each of the shut-off bodies 10 is assigned a spring 11 which presses the shut-off body 10 downward in the drawing. One of the springs 11 is shown in FIG. 11 by way of example.

Figure 12:
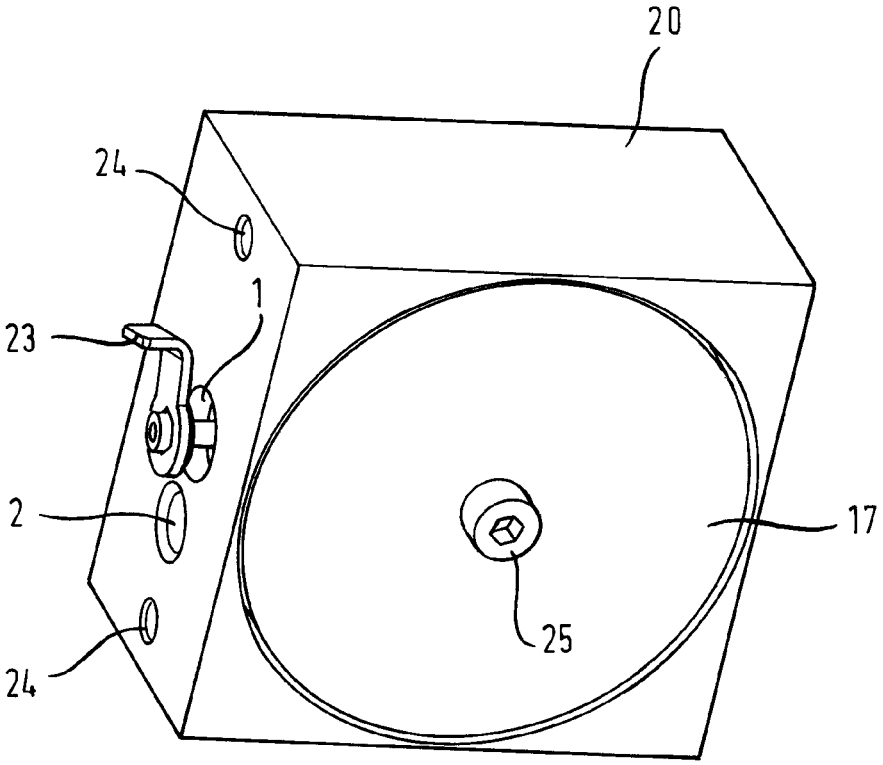
FIG. 12 shows the gas valve unit in a perspective view obliquely from below.

FIG. 12 shows the gas valve unit in a perspective view obliquely from below. Evident here in particular is a closing plate 17 which presses together the remaining plates not shown in the figure, the valve sealing plate 12, the pressure plate 13, the first gas distribution plate 14, the throttle plate 15 and the second gas distribution plate 16. The force required for this is generated by means of a bolt 25.

Figure 13:
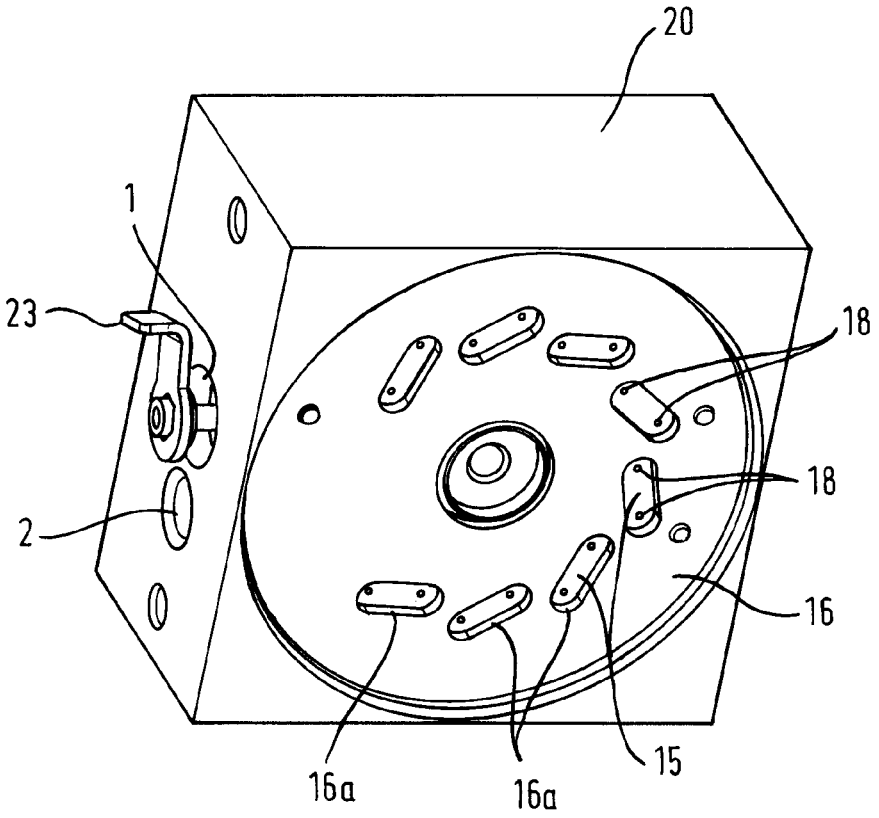
FIG. 13 shows the perspective view looking onto a lower gas distribution plate.

FIG. 13 shows the view according to FIG. 12 with closing plate 17 removed. Evident here is the second gas distribution plate 16 having the apertures 16*a*. Sections of the throttle plate 15 with the throttle openings 18 contained therein can be seen through said apertures 16*a*. It can also be seen that two throttle openings 18 in each case are connected via an aperture 16*a* of the second gas distribution plate 16.

Figure 14:
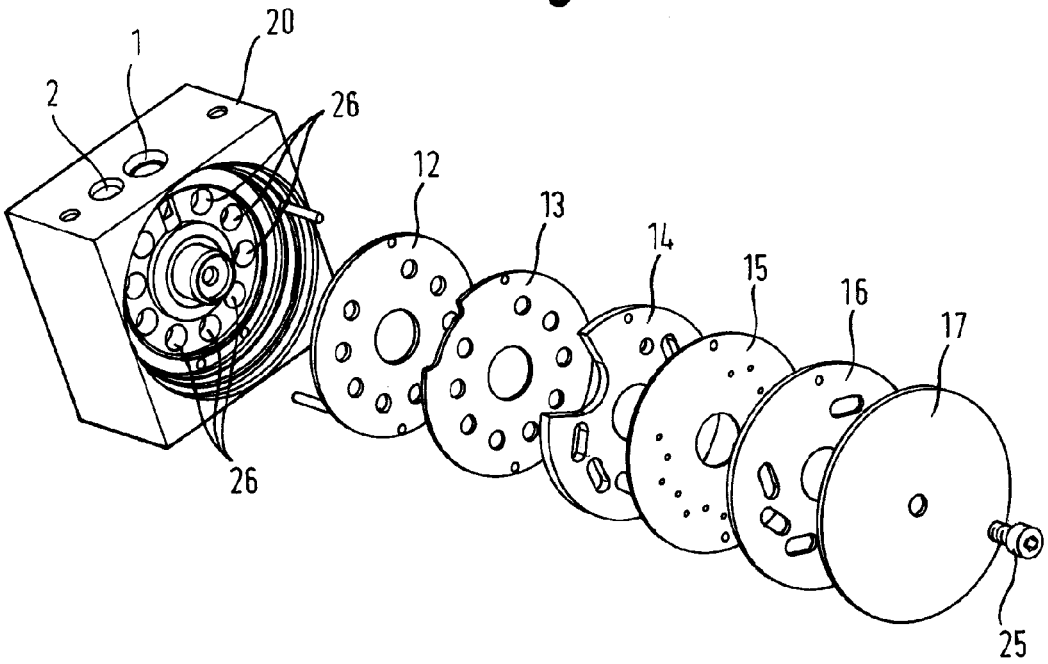
FIG. 14 is an exploded view of the gas valve unit, looking obliquely from below.

The layer-by-layer structure of the gas valve unit is illustrated with the aid of FIG. 14 in an exploded view. Evident here is the valve body 20 with guide boreholes 26 for the shut-off bodies 10 (not shown in the present view) of the open/close valves 3. The below-cited plates are inserted into the valve body 20 in the following order: valve sealing plate 12, pressure plate 13, first gas distribution plate 14, throttle plate 15, second gas distribution plate 16, closing plate 17. The bolt 25 presses the plates 12, 13, 14, 15, 16, 17 supported on the valve body 20 onto one another.

In the present exemplary embodiment the plates 12, 13, 14, 15, 16, 17 are inserted individually into the valve body 20. It is, however, also possible to prefabricate the plates 12, 13, 14, 15, 16, 17 as a package so that they can only be inserted into the valve body 20 and removed again all together. In order to convert the gas valve unit to another type of gas it will then be necessary, depending on the design, to replace either just the throttle plate 15 or the entire package composed of the plates 12, 13, 14, 15, 16, 17.

Figure 15:
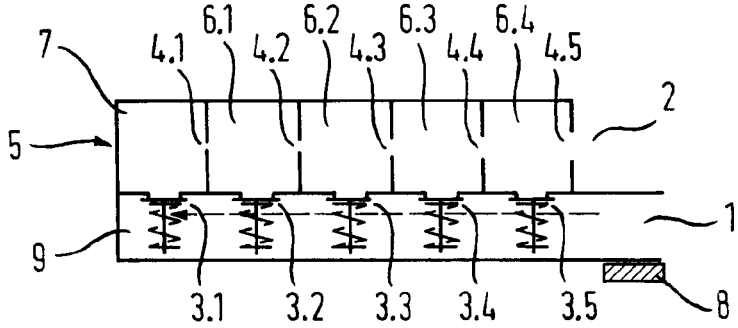
FIG. 15 shows a variant of the switching arrangement according to FIGS. 1-3 in the fully closed state.

FIG. 15 shows a variant of the switching arrangement according to FIGS. 1 to 3. The arrangement of the throttle segment 5 with the throttle points 4 (4.1 to 4.5) corresponds exactly to the arrangement according to FIGS. 1 to 3. The arrangement of the gas inlet chamber 9, as well as of the open/close valves 3 (3.1 to 3.5), also corresponds to the exemplary embodiment according to FIGS. 1 to 3. In contrast to the exemplary embodiment according to FIGS. 1 to 3 the gas inlet 1 is located on the right-hand side of the gas inlet chamber 9 in the drawing. However, the location of the gas inlet 1 in relation to the gas inlet chamber 9 and hence also the flow direction of the gas inside the gas inlet chamber 9 are largely immaterial for the functioning of the gas valve unit. Within the throttle segment 5 the gas flows, analogously to the arrangement according to FIGS. 1 to 3, in the left-to-right direction. Accordingly, the throttle point 4.1 on the left in the drawing is designated as the first throttle point. The throttle point 4.5 on the right in the drawing is designated as the last throttle point. Observing this nomenclature, the open/close valve 3.1 on the left in the drawing will be referred to in the following—as also in the exemplary embodiment according to FIGS. 1 to 3—as the first open/close valve and the open/close valve 3.5 on the right in the drawing as the last open/close valve.

In the switching position shown in FIG. 15 the permanent magnet 8 is located to the right of the last open/close valve 3.5. The permanent magnet 8 therefore exerts a magnetic force on none of the open/close valves 3, which consequently means that none of the open/close valves 3.1 to 3.5 is open. Thus, the gas valve unit is fully closed and the connection between gas inlet 1 and gas outlet 2 is completely blocked.

In order to open the gas valve unit starting from this switching position, the permanent magnet 8 is shifted to the left into the region of the last open/close valve 3.5.

Figure 16:
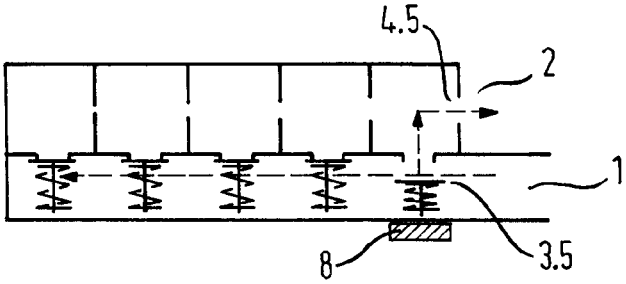
FIG. 16 shows the variant of the switching arrangement in the fully open state with one open/close valve open.

This switching position, in which the gas valve unit is open at a maximum, is shown in FIG. 16. In this case the gas flows from the gas inlet 1 via the opened last open/close valve 3.5 and the last throttle point 4.5 directly to the gas outlet 2. The last throttle point 4.5 can have an opening cross-section that is so great that practically no throttling of the gas flow takes place. In this case the gas flow passes practically unobstructed through the gas valve unit.

Figure 17:
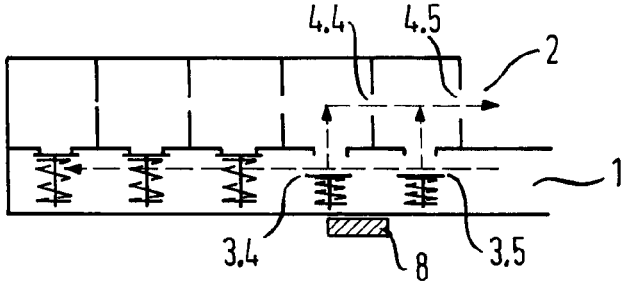
FIG. 17 shows the variant of the switching arrangement in the fully open state with two open/close valves open.

As a result of the permanent magnet 8 being moved to the left in the drawing, the gas flow through the gas valve unit can now be throttled in stages. FIG. 17 shows an intermediate position of the permanent magnet 8 in which the latter opens both open/close valves 3.4 and 3.5. In this case, however, the volumetric gas flow to the gas outlet 2 is practically identical to the volumetric gas flow in the switching position according to FIG. 16.

Figure 18:
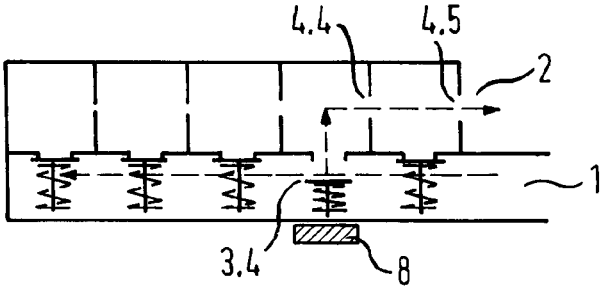
FIG. 18 shows the variant of the switching arrangement in the partially open state.

In the switching position according to FIG. 18 the permanent magnet opens only the open/close valve 3.4. On the way to the gas outlet 2 the gas flow leads both through the throttle point 4.4 and through the throttle point 4.5. The opening cross-section of the throttle point 4.4 is smaller than the opening cross-section of the throttle point 4.5, with the result that the gas flow is somewhat throttled.

Figure 19:
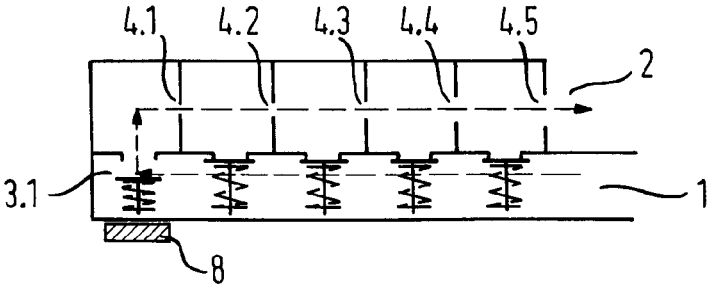
FIG. 19 shows the variant of the switching arrangement in the minimum open state.

FIG. 19 shows the gas valve unit in the minimum opening position, in which only the open/close valve 3.1 is open. On the way to the gas outlet 2 the gas flows through all of the throttle points 4.1 to 4.5. Viewed in the gas flow direction in the throttle segment 5, the throttle points 4 possess an increasing cross-section. Accordingly, the volumetric gas flow becoming established is mainly determined by the throttle point 4.1, which possesses the smallest opening cross-section. The flow resistance caused by the remaining throttle points 4.2 to 4.5 and likewise influencing the volumetric gas flow is taken into account in the dimensioning of the opening cross-sections.

In the switching arrangement according to FIGS. 15 to 19 the gas valve unit is located immediately in its maximum open position when it is actuated starting from its closed position. This has the positive effect that the gas-conducting lines and gas burners disposed downstream of the gas valve unit fill particularly quickly with gas. Furthermore, the gas burner can be ignited immediately after the opening of the gas valve unit at maximum volumetric gas flow, thereby facilitating the ignition process.

LIST OF REFERENCE SIGNS

1 Gas inlet
2 Gas outlet
3 (3.1 to 3.5) Open/close valves
4 (4.1 to 4.5) Throttle points
5 Throttle segment
6 (6.1 to 6.4) Connecting section
7 Inlet section
8 Permanent magnet
9 Gas inlet chamber
10 Shut-off body
11 Spring
12 Valve sealing plate
12*a* Orifices
13 Pressure plate
13*a* Apertures
14 First gas distribution plate
14*a* Apertures
15 Throttle plate
16 Second gas distribution plate
16*a* Apertures
17 Closing plate
18 Throttle openings
20 Valve body
21 Switching shaft
22 Driver
23 Actuating lever
24 Boreholes
25 Bolt
26 Guide boreholes
27 Cover

The invention claimed is:

1. A gas valve unit for adjusting a volumetric gas flow supplied to a gas burner of a gas appliance, said gas valve unit comprising:

a gas inlet, at least two open/close valves, the at least two open/close valves being connected on an inlet side to the gas inlet via a common gas inlet chamber, such that the inlet side of the at least two open/close valves is in constant, unrestricted communication with the gas inlet, with at least a portion of each of the at least two open/close valves being disposed within the common gas inlet chamber, at least two throttle points arranged in series and forming a throttle segment, with adjacent throttle points being connected via a connecting section, and a gas outlet, wherein a first and a second open/close valve of the at least two open/close valves are arranged adjacent to each other and a first and a second connecting section of the throttle segment are arranged adjacent to each other;

wherein an outlet side of the first open/close valve leads into the first connecting section of the throttle segment and an outlet side of the second open/close valve leads into the second connecting section of the throttle segment, and wherein—as viewed in a gas flow direction from the gas inlet to the gas outlet—the throttle points have a sequentially increasing opening cross-section.

2. The gas valve unit of claim 1, wherein the gas appliance is a gas cooking appliance.

3. The gas valve unit of claim 1, comprising a plurality of throttle points forming a throttle segment, wherein an open/close valve leads into each of the connecting sections in one-to-one correspondence.

4. The gas valve unit of claim 3, comprising at least four throttle points.

5. The gas valve unit of claim 1, wherein the throttle segment has an inlet section disposed upstream of a first of the at least two throttle points—as viewed in the gas flow direction—, said inlet section being connected to the outlet side of one of the at least two open/close valves.

6. The gas valve unit of claim 1, wherein each throttle point comprises at least one throttle opening.

7. The gas valve unit of claim 6, wherein the at least one individual throttle comprises a throttle opening having a defined flow cross-section.

8. The gas valve unit of claim 6, wherein at least one throttle point comprises two throttle openings arranged in series.

9. The gas valve unit of claim 1, wherein a volumetric gas flow flowing through the gas valve unit is equal to zero when all of the at least two open/close valves are closed.

10. The gas valve unit of claim 5, wherein when only the one of the at least two open/close valves is open, a volumetric gas flow flowing through the gas valve unit has a minimum value at which the gas burner operates at minimum power.

11. The gas valve unit of claim 1, wherein when at least the open/close valve leading into a connecting section of the throttle segment disposed farthest downstream—as viewed in the gas flow direction—is open, a volumetric gas flow flowing through the gas valve unit has a maximum value at which the gas burner operates at maximum power.

12. The gas valve unit of claim 5, wherein when at least one of the open/close valves leading into a middle connecting section disposed between the inlet section and a connecting section of the throttle segment disposed farthest downstream—as viewed in the gas flow direction—is open, and at least the open/close valves which lead into a connecting section disposed downstream of the middle connecting section are closed, a volumetric gas flow flowing through the gas valve unit has an intermediate value at which the gas burner operates at a power between a minimum power and a maximum power.

13. The gas valve unit of claim 1, further comprising an actuating mechanism operating the at least two open/close valves, wherein the actuating mechanism is constructed to at least one of:

close all of the at least two open/close valves, to open only one of the at least two open/close valves, and to open precisely two open/close valves, wherein the precisely two open/close valves which are open are connected to two adjacent connecting sections or to an inlet section formed by the throttle segment disposed upstream of a first of the at least two throttle points—as viewed in the gas flow direction—and an adjacent connecting section.

14. The gas valve unit of claim 13, wherein the actuating mechanism comprises a permanent magnet.

15. The gas valve unit of claim 1, wherein each of the at least two open/close valves comprises a movable shut-off body which bears against a valve seat when the open/close valve is closed, thereby sealing a valve orifice in the valve seat.

16. The gas valve unit of claim 15, wherein the shut-off body is pressed onto the valve seat by a spring when the open/close valve is closed, and wherein the open/close valve is opened by lifting the shut-off body off the valve seat through application of a force from a permanent magnet.

17. The gas valve unit of claim 16, wherein the open/close valve is actuated by varying a position of the permanent magnet in relation to the shut-off body.

18. The gas valve unit of claim 11, wherein when the gas valve unit is opened—starting from a closed position in which all of the open/close valves are closed—, by first opening the open/close valve leading into a connecting section of the throttle segment disposed farthest downstream, as viewed in a gas flow direction.

19. A gas valve unit for adjusting a volumetric gas flow supplied to a gas burner of a gas appliance, in particular a gas cooking appliance, the gas valve unit comprising:

a gas inlet;

at least two open/close valves;

at least two throttle points and a gas outlet;

wherein the gas valve unit includes a throttle segment in which the throttle points are arranged in series and which has a connecting section between two adjacent throttle points in each case;

wherein the at least two open/close valves are connected on an inlet side to the gas inlet via a common gas inlet chamber, such that the inlet side of the at least two open/close valves is in constant, unrestricted communication with the gas inlet, with at least a portion of each of the at least two open/close valves being disposed within the common gas inlet chamber, and on the outlet side at least one open/close valve leads into a connecting section of the throttle segment;

wherein the throttle segment has at least four throttle points, that the throttle segment has a connecting section between two adjacent throttle points in each case, and that an open/close valve leads into each of the connecting sections; and wherein—as viewed in a gas flow direction from the gas inlet to the gas outlet—the throttle points have a sequentially increasing opening cross-section.

* * * * *